United States Patent [19]

Krippner

[11] 4,389,822

[45] Jun. 28, 1983

[54] HEAD FOR PASSAGES, DOOR AND WINDOW OPENINGS

[76] Inventor: Mathilde Krippner, Sonnenbichl 21, 8952 Marktoberdorf, Fed. Rep. of Germany

[21] Appl. No.: 288,352

[22] Filed: Jul. 30, 1981

Related U.S. Application Data

[63] Continuation of Ser. No. 916,579, Jun. 19, 1978, abandoned.

[30] Foreign Application Priority Data

Jun. 20, 1977 [DE] Fed. Rep. of Germany ..... 2727625

[51] Int. Cl.[3] ..... E06B 1/04

[52] U.S. Cl. ..... 52/125.4; 52/204; 52/88; 52/609; 52/612

[58] Field of Search ..... 52/85, 88, 125, 204, 52/206, 207, 609, 311, 612

[56] References Cited

U.S. PATENT DOCUMENTS

| | | | |
|---|---|---|---|
| 545,884 | 9/1895 | Fry | 52/216 |
| 743,946 | 11/1903 | Spaulding | 52/87 |
| 957,048 | 5/1910 | Francis | 52/723 |
| 1,074,268 | 9/1913 | Kelly | 52/88 |
| 1,226,743 | 5/1917 | Bowman | 52/211 |
| 1,698,524 | 1/1929 | Allen | 52/209 |
| 1,990,001 | 2/1935 | Ratten | 52/723 |
| 2,095,072 | 10/1937 | Ludden | 52/204 |
| 2,351,856 | 6/1944 | Henderson | 52/206 |
| 2,841,254 | 7/1958 | Miller | 52/217 |
| 3,186,400 | 6/1965 | Lunt | 52/204 |
| 3,286,418 | 11/1966 | Radford | 52/612 |
| 3,421,269 | 1/1969 | Medow | 52/86 |
| 3,750,355 | 8/1973 | Blum | 52/612 |
| 4,069,629 | 1/1978 | Piazza | 52/612 |

FOREIGN PATENT DOCUMENTS

| | | | |
|---|---|---|---|
| 817198 | 10/1951 | Fed. Rep. of Germany | 52/216 |
| 2828701 | 1/1980 | Fed. Rep. of Germany | 52/204 |
| 801825 | 8/1936 | France | 52/204 |
| 2121 | of 1875 | United Kingdom | 52/204 |
| 1021562 | 3/1966 | United Kingdom | 52/211 |
| 1479593 | 7/1977 | United Kingdom | 52/204 |

*Primary Examiner*—Alfred C. Perham
*Assistant Examiner*—Henry E. Raduazo
*Attorney, Agent, or Firm*—Oblon, Fisher, Spivak, McClelland & Maier

[57] ABSTRACT

The invention provides a novel beam for covering wall openings in order to facilitate constructional work at building sites. For this purpose a prefabricated beam consisting of one piece is suggested, which without any additional scaffolds being required may be placed over a wall opening as one unit.

6 Claims, 5 Drawing Figures

HEAD FOR PASSAGES, DOOR AND WINDOW OPENINGS

This is a continuation of application Ser. No. 916,579, filed June 19, 1978 and now abandoned.

BACKGROUND OF THE INVENTION

1. Field of the Invention

The invention relates to a head for passages, door and window openings, having a bottom side elevated in respect of its supporting surfaces.

2. Description of the Prior Art

According to hitherto practice heads e.g. of an arch shape have been produced at the building site by casing the respective wall opening according to the desired shape and composing the head of the building blocks or casting it from concrete. Moreover, when using building blocks the rest of the brickwork had to be adapted to the arch. This way of making a head is inefficient.

SUMMARY OF THE INVENTION

It is therefore the object of the invention to provide a head of the aforementioned type in order that an efficient working at the building site is made possible.

According to the invention this problem is solved by constructing the head as a prefabricated, one-piece beam of a homogeneous material.

The advantage of such a head is that it can be efficiently placed on a prepared mounting surface in the brickwork of the wall opening. For doing so, no casing whatsoever is required so that the work can be performed by unskilled laborers or laymen, respectively.

When the top side of the head only comprises horizontal and vertical surfaces an easier adaption thereto of the remaining brickwork is guaranteed. This applies in particular when the head is rectangularly stepped, the height of the steps being preferably 125 mm and the width of the steps 125 mm, as well so that the bricks of the adjacent brickwork may be exactly fitted into these steps vertically and with half their length, considering the joints, without the complicated adaption to the bricks being necessary.

In order to avoid unnecessary fitting work as regards that part starting with the height of the supporting surfaces to the beginning of the first step the head is so designed that the faces adjacent to the supporting surfaces are of a height being a multiple of that of one step.

For an efficient series production of prefabricated beams it is advantageous that the latter have a depth of 115, 145 or 175 mm because therewith the head is flush-mountable into any ordinary wall having a thickness of between 115 and 490 mm by combining beams of different or equal depth.

The beams are cast from lignt-weight or breeze concrete or gas concrete in order that they can be mounted at the building site with the aid of conventional constructural lifting equipments. In order to avoid a formation of cracks or a damage of the beams during their transportation from the place of production to the building site it is advantageous if a steel reinforcement—canted in the step area—is incorporated into the beam along its contour. For the sake of a better mounting one or several lifting loops are anchored at the reinforcement, protruding from the top side of the beam.

If, for example, a full-center arch is to have a visible brickwork the cross-section of the beam can be of an L- or inverted T-shape. The bricks can then be placed on the L-shaped or T-shaped leg or legs, respectively, adjacent to the arch of the beam and can be blocked up.

In particular when using the head for door and window openings it is convenient if the cross-section of the beam has a shoulder on the bottom side serving as an abutment for the door or window frame.

When using the head for window openings it is preferable that the beam consists of two halfs disposed laterally reversed to one another in the longitudinal direction of the beam, whose cross-sections, each, have on the top side a horizontal rectangular shoulder forming together an U-shaped groove. In this groove there is space for a roll shutter box; moreover, the two halfs of the beam may be mounted at a distance from each other so that between them there is enough space for the guide rollers of the roll shutter.

Especially when using the head in outside walls, it may be made of two beams having an insulation therebetween.

A troublefree fitting of the beam into the brickwork is guaranteed by the fact that the total height and length of the beam are a multiple of the height and width of the steps.

BRIEF DESCRIPTION OF THE DRAWINGS

Various other objects, features and attendant advantages of the present invention will be better understood from the following detailed description when considered in connection with the accompanying drawings in which like reference characters designate like or corresponding parts throughout the several views, and wherein.

Figure 1:
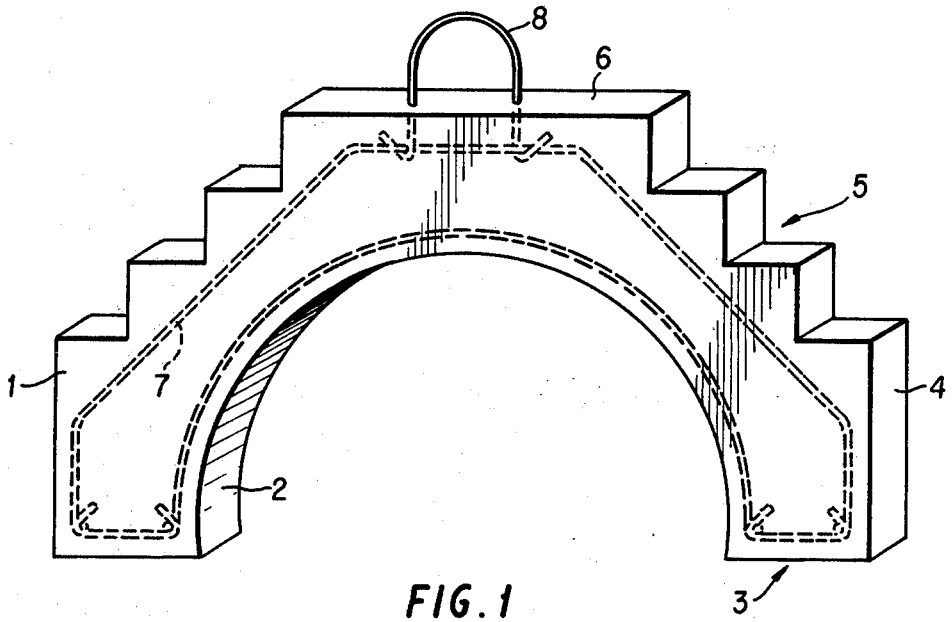
FIG. 1 is a view of a prefabricated head.

The beam 1 has on its bottom side a semi-cylindrical surface 2 rectangularly adjoining the two horizontal supporting surfaces 3. At right angle, from the respective outer edges of the supporting surfaces there extend vertically in the upward direction lateral faces 4 leading via steps 5 to a horizontal surface 6 forming the top side of the beam. The steps 5 have a height and a width of 125 mm, each; the total length of beam 1, the height of the faces 4 and the length of the horizontal surface 6, each, are a multiple of 125 mm.

Along the contours of the beam 1, in the region of steps 5 however only along the raiser of the steps, a steel reinforcement 7 of round steel is inserted in a manner that it is covered all over by at least 3 cm of concrete. In the area of the horizontal face 6 on the upper side of the steel reinforcement 7 a lifting loop 8 is anchored, protruding upwardly from beam 1. This lifting loop being likewise produced of round steel and having a diameter of 12 mm, as well as reinforcement 7 are substantially provided for transporting and mounting the beam in order to avoid cracks forming or parts breaking off the beam during transportation. Furthermore, they facilitate fitting in the head. After the head has been built in, the lifting loop 8 is removed with a suitable tool.

Figure 2:
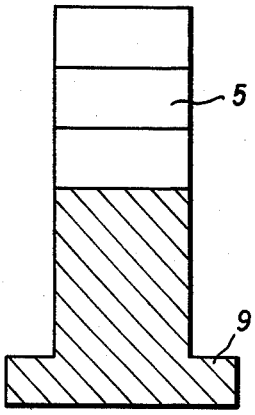
FIGS. 2–5 are cross-sectional views of further embodiments of the prefabricated head.

The legs of an embodiment having the inverted T-shaped cross section are shown at 9 in FIG. 2.

Figure 3:
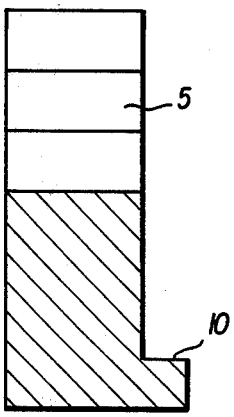

The legs of an embodiment having the L-shaped cross-section are shown at 10 in FIG. 3.

Figure 4:
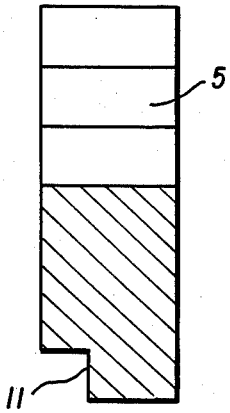

FIG. 4 shows an embodiment having a shoulder 11 in cross section. The shoulder 11 serves as an abutment for a door or window frame.

Figure 5:
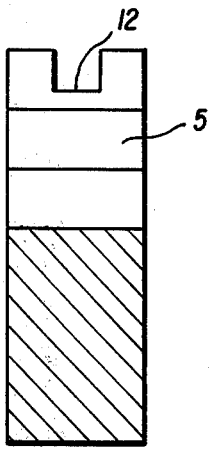

FIG. 5 shows an embodiment in which the cross-section of the beam shows a U-shaped groove 12.

Obviously, numerous modifications and variations of the present invention are possible in light of the above teachings. It is therefore to be understood that within the scope of the appended claims, the invention may be practiced otherwise than as specifically described herein.

I claim:

1. A head for passages and door or window openings in brickwork, said head being formed from a prefabricated one-piece beam having two supporting surfaces on opposite sides of a passage, a bottom side between said supporting surfaces, said bottom side being elevated in respect to said supporting surfaces, said head being constructed of light-weight concrete or gas concrete and having a configuration wherein said bottom side of the beam has the shape of an arch and is substantially semi-circular with a center of curvature not substantially below a line connecting said supporting surfaces thus producing substantially little or no tensile load during use, said beam further having a top side which is rectangularly stepped, and a steel reinforcement being incorporated into said beam along its length and conforming to its contour, said reinforcement being canted in the step area, where by said steel provides tensile strength for shipping and handling, but in use suplements the compressive strength of said gas concrete.

2. The head according to claim 1 wherein on said top side of said beam one or several lifting loops of reinforcement steel are anchored in said reinforcement.

3. The head according to claim 1 wherein the total height and the total length of said beam are a multiple of the height and the width of one said step.

4. The head of claim 1 wherein said beam has an L-shaped cross-section, the leg of said L forming a support for brickwork.

5. The head of claim 1 wherein said beam has an inverted T cross-section, the leg of said inverted T forming a support for brickwork.

6. The head of claim 1 wherein the cross section of said beam has a shoulder on its bottom side, said shoulder serving as an abutment for a door or window frame.

* * * * *